US010124208B1

(12) United States Patent
Balsley

(10) Patent No.: US 10,124,208 B1
(45) Date of Patent: Nov. 13, 2018

(54) PEDAL EXERCISER MOUNTING FRAME AND RELATED ASSEMBLIES AND METHODS

(71) Applicant: Alex L. Balsley, Jacksonville, FL (US)

(72) Inventor: Alex L. Balsley, Jacksonville, FL (US)

( * ) Notice: Subject to any disclaimer, the term of this patent is extended or adjusted under 35 U.S.C. 154(b) by 20 days.

(21) Appl. No.: 15/804,270

(22) Filed: Nov. 6, 2017

Related U.S. Application Data

(62) Division of application No. 15/068,798, filed on Mar. 14, 2016, now Pat. No. 9,814,933.

(60) Provisional application No. 62/134,793, filed on Mar. 18, 2015.

(51) Int. Cl.

| | |
|---|---|
| ***A63B 22/06*** | (2006.01) |
| ***A63B 69/16*** | (2006.01) |
| ***A63B 23/035*** | (2006.01) |
| ***A63B 22/00*** | (2006.01) |

(52) U.S. Cl.
CPC ..... *A63B 22/0694* (2013.01); *A63B 22/0007* (2013.01); *A63B 22/0605* (2013.01); *A63B 23/0355* (2013.01)

(58) Field of Classification Search
CPC .... A63B 22/06; A63B 23/055; A63B 22/0007
See application file for complete search history.

(56) References Cited

U.S. PATENT DOCUMENTS 3,622,153 A * 11/1971 Thompson ..... A63B 22/001 482/60
3,758,111 A * 9/1973 Agamian ..... A63B 22/0694 482/57
3,848,870 A * 11/1974 Craig ..... A63B 21/023 108/140
3,910,571 A * 10/1975 Stenn ..... A63B 22/0605 482/60
4,265,447 A * 5/1981 Shafer ..... A47B 31/06 108/44
4,390,177 A * 6/1983 Biran ..... A63B 21/1609 188/83
4,925,184 A * 5/1990 McJunkin, Jr. .... A63B 22/0605 482/60
4,971,317 A * 11/1990 Link ..... A63B 22/0694 472/128
4,973,046 A * 11/1990 Maxwell ..... A63B 21/00178 482/60

(Continued)

*Primary Examiner* — Stephen R Crow
*Assistant Examiner* — Garrett Atkinson
(74) *Attorney, Agent, or Firm* — Allen Dyer Doppel & Gilchrist, PA

(57) ABSTRACT

A mounting frame for releasably securing a pedal exerciser to a table is disclosed. The mounting frame includes a frame assembly having a pair of generally opposed end members dimensioned to extend across an upper surface of the table and configured to receive feet of the pedal exerciser, and a pair of generally opposed side members connected to the pair of generally opposed end members at corresponding ends thereof, so as to cooperatively define a central aperture therewith with the pair of generally opposed side members configured to engage opposite sides of the table. The frame assembly further includes a first strap dimensioned to extend across the central aperture and engage the pair of generally opposed side members so as to releasably secure the table therebetween.

14 Claims, 8 Drawing Sheets

(56) References Cited

U.S. PATENT DOCUMENTS

| | | | | | |
|---|---|---|---|---|---|
| 5,027,794 | A * | 7/1991 | Pyle | A63B 21/00181 | 482/119 |
| 5,108,092 | A * | 4/1992 | Hurst | A63B 22/0005 | 482/60 |
| 6,623,406 | B2 * | 9/2003 | Wu | A63B 22/0664 | 482/51 |
| 7,160,231 | B2 * | 1/2007 | Kazemi | A63B 22/0056 | 482/60 |
| 7,497,811 | B2 * | 3/2009 | Kumar | A63B 21/0083 | 482/57 |
| 7,637,854 | B2 * | 12/2009 | Jang | A61H 1/0222 | 482/142 |
| 7,883,453 | B1 * | 2/2011 | Cooper | A63B 23/0211 | 482/140 |
| D637,664 | S * | 5/2011 | Battison | A63B 21/012 | D21/663 |
| D681,136 | S * | 4/2013 | Liu | D21/663 | |
| 2003/0092536 | A1 * | 5/2003 | Romanelli | A61H 1/0214 | 482/60 |

* cited by examiner

PEDAL EXERCISER MOUNTING FRAME AND RELATED ASSEMBLIES AND METHODS

CROSS-REFERENCE TO RELATED APPLICATION

The present application claims the benefit of U.S. patent application Ser. No. 15/068,798 filed on Mar. 14, 2016, which claims the benefit of U.S. Provisional Patent Application Ser. No. 62/134,793, filed on Mar. 18, 2015, the contents of which applications are herein incorporated by reference in their entirety.

FIELD OF THE INVENTION

The present invention relates to pedal exerciser mounting frames, and more particularly, to pedal exerciser mounting frames configured to engage with bedside tables used in hospitals and nursing homes.

BACKGROUND OF THE INVENTION

Pedal exercisers are commonly used in nursing homes and hospitals. While a pedal exerciser is generally used to improve the strength of legs and to rehabilitate a patient with certain leg injuries, it can also be used to strengthen a patient's upper body. Referring to FIG. 8, a pedal exerciser is shown and referred to generally by the reference PE that has a length L and a width W. Typically, the pedal exerciser PE is fitted with four corner feet F, with each foot having a foot width FW and a foot length FL, with a first pair of feet F being connected to a forward rod FR and a second pair of feet F connected to a rear rod FR. While the dimensions for the pedal exercisers PE made by various manufacturers vary somewhat, they usually fall within a relatively narrow range.

When used to exercise the upper body, the pedal exerciser is normally fitted to the top of a standard bedside table, weighted down and held by hand to use at the bedside. However, it is difficult to secure and stabilize the pedal exerciser to the bedside table, thereby jeopardizing a patient's safety while exercising. Although the patient can still exercise with the pedal exerciser on the standard bedside table, further improvements are needed to protect the safety of the patient.

SUMMARY OF THE INVENTION

In view of the foregoing, it is an object of the present invention to provide a pedal exerciser mounting frame and related methods. In one embodiment, the mounting frame includes a frame assembly having a pair of generally opposed end members dimensioned to extend across an upper surface of a bedside table and configured to receive feet of the pedal exerciser, and a pair of generally opposed side members connected to the pair of generally opposed end members at corresponding ends thereof, so as to cooperatively define a central aperture exposing the upper surface of the table, with the pair of generally opposed side members configured to engage opposite sides of the table. The frame assembly further includes a first strap dimensioned to extend across the central aperture and engage the pair of generally opposed side members so as to releasably secure the table therebetween.

A method of mounting a pedal exerciser to an upper surface of a bedside table with the mounting frame is disclosed. The method includes mounting the frame assembly on the table by engaging the pair of side members to opposite sides of the table. The mounting frame is secured to the table by extending the first strap across the central aperture and the pair of the side members. A plurality of feet of the pedal exerciser is placed in corresponding recesses located at end portions of the pair of end members.

These and other objects, aspects and advantages of the present invention will be better understood in view of the drawing and following detailed description of preferred embodiments.

DETAILED DESCRIPTION OF PREFERRED EMBODIMENTS

Figure 8:
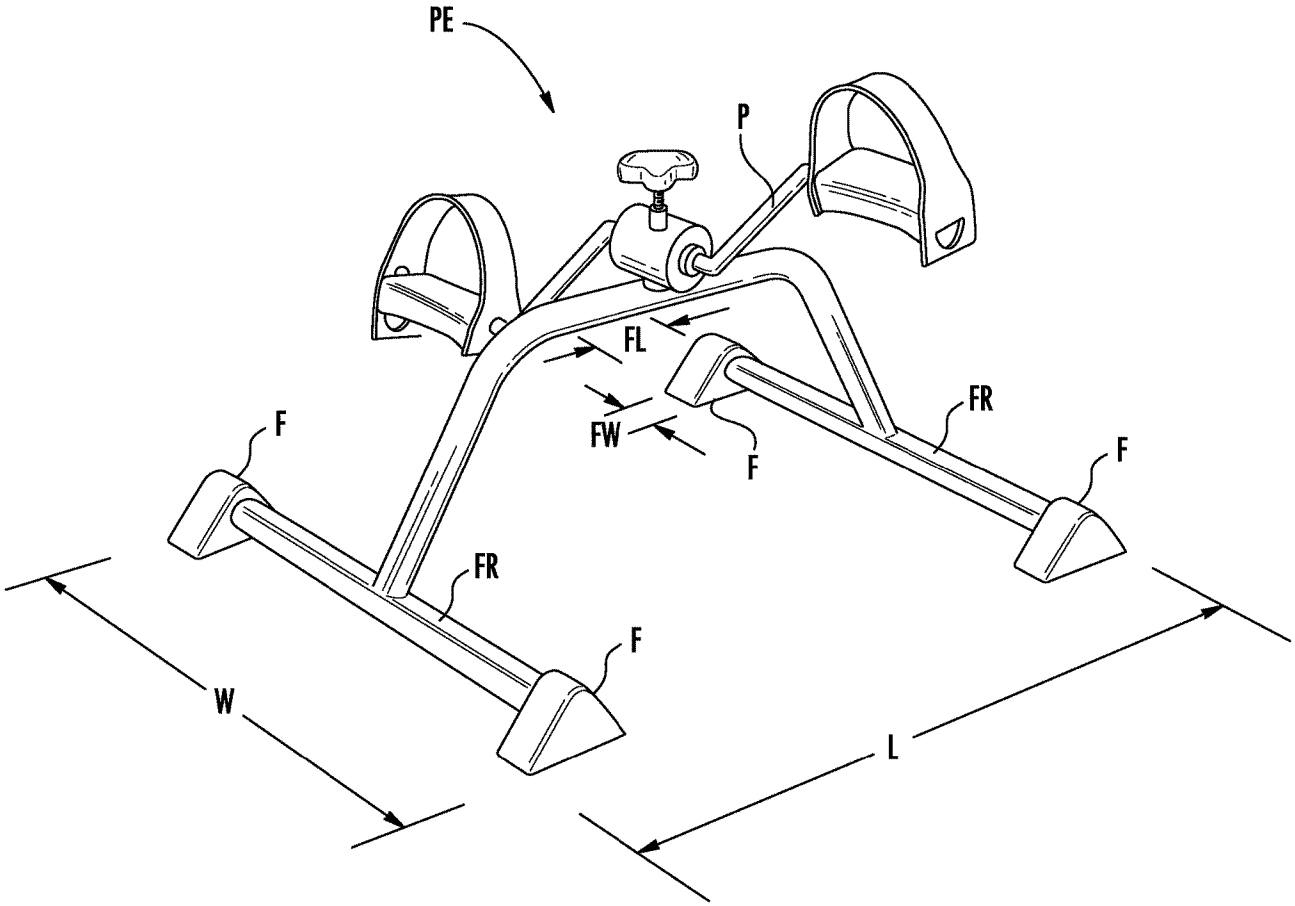
FIG. 8 is a perspective view of a pedal exerciser for use in connection with a pedal exerciser mounting frame.

According to a first embodiment of the present invention, referring to FIGS. 1-5, a pedal exerciser mounting frame 10 includes a frame assembly 12 and a first strap 14. The mounting frame 10 is configured to mount to the upper surface 17 of a pedestal mounted standard overbed table 16. The mounting frame 10 accommodates the pedal exerciser PE of FIG. 8.

The frame assembly 12 has a generally opposed pair of end members 20 and a generally opposed pair of side members 22. The pair of end members 20 and the pair of side members 22 define a central aperture 25 and are dimensioned such that a length L and width W of the frame assembly 12 is slightly greater than the footprint of a typical pedal exerciser, such as that identified as PE in FIG. 8.

Figure 1:
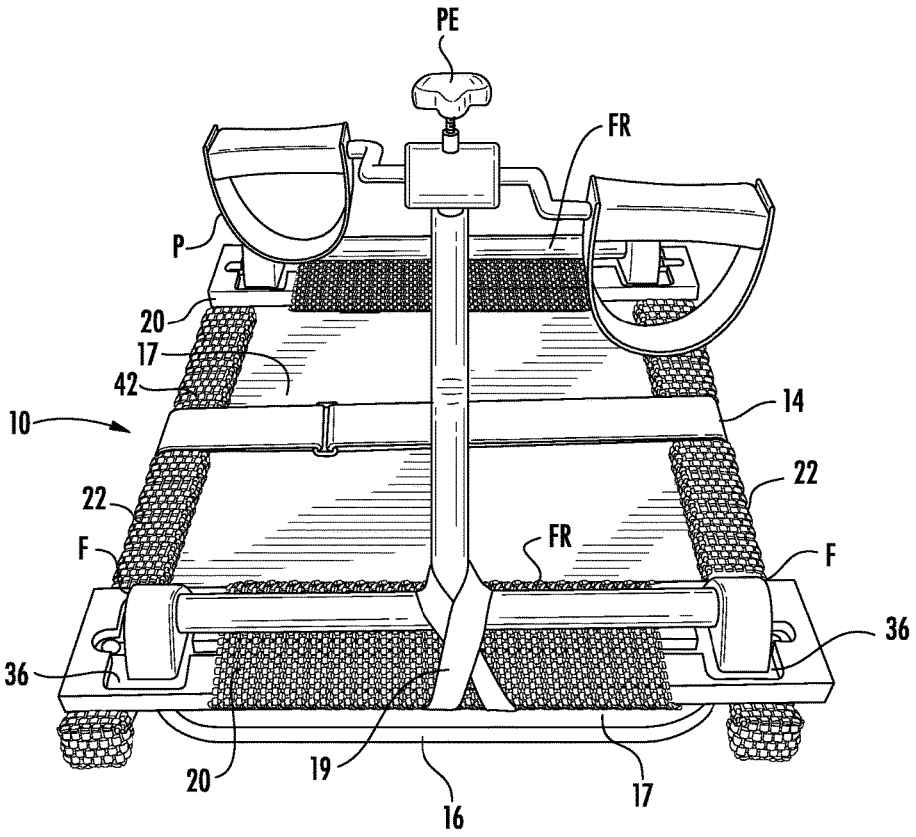
FIG. 1 is a perspective view of a pedal exerciser mounting frame, according to a first embodiment of the present invention, releasably securing a pedal exerciser to a bedside table.
Figure 2:
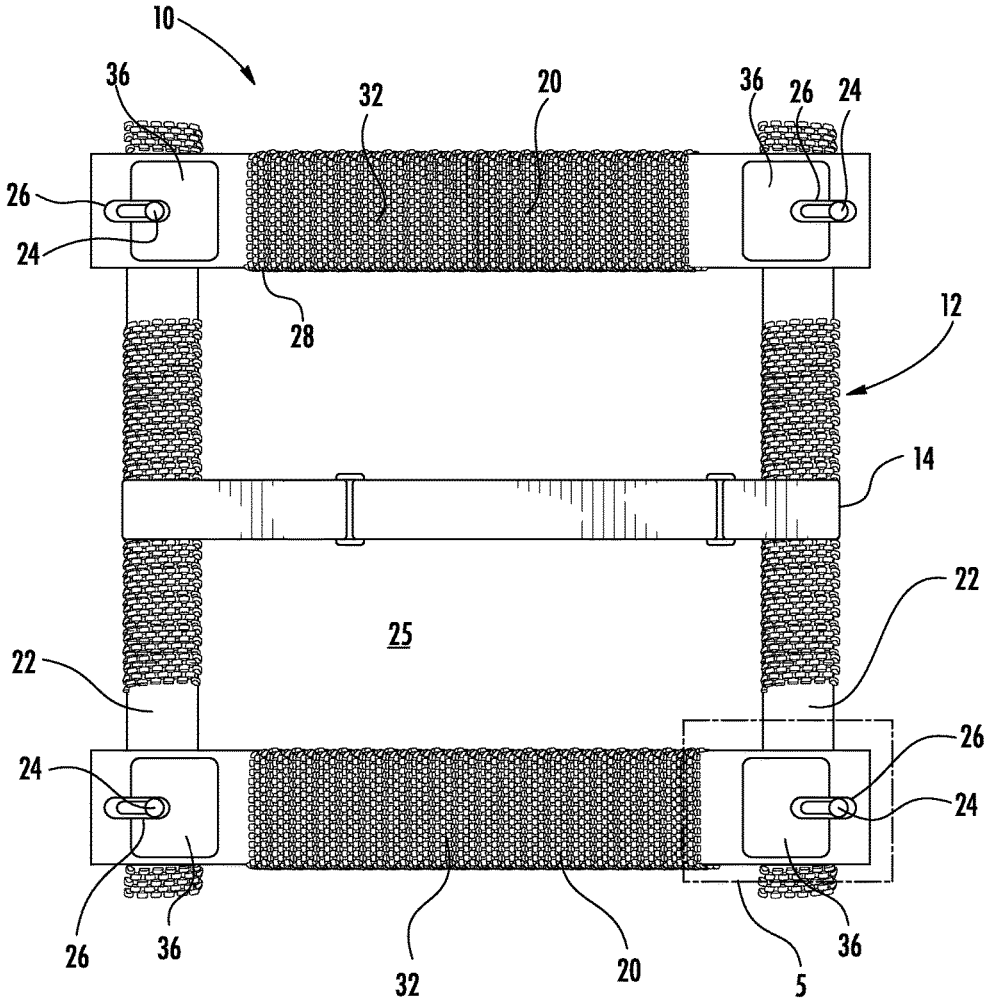
FIG. 2 is an upper perspective view of the pedal exerciser mounting frame of FIG. 1.
Figure 3:
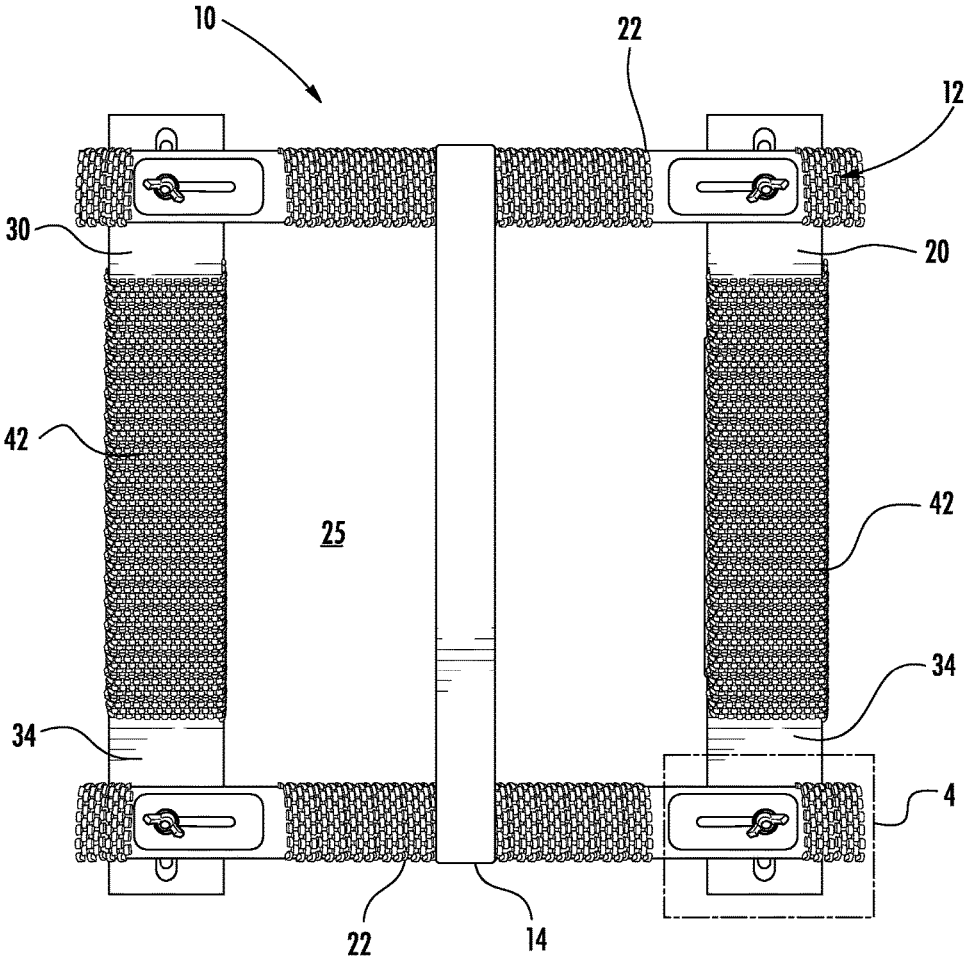
FIG. 3 is a lower perspective view of the pedal exerciser mounting frame of FIG. 1.
Figure 4:
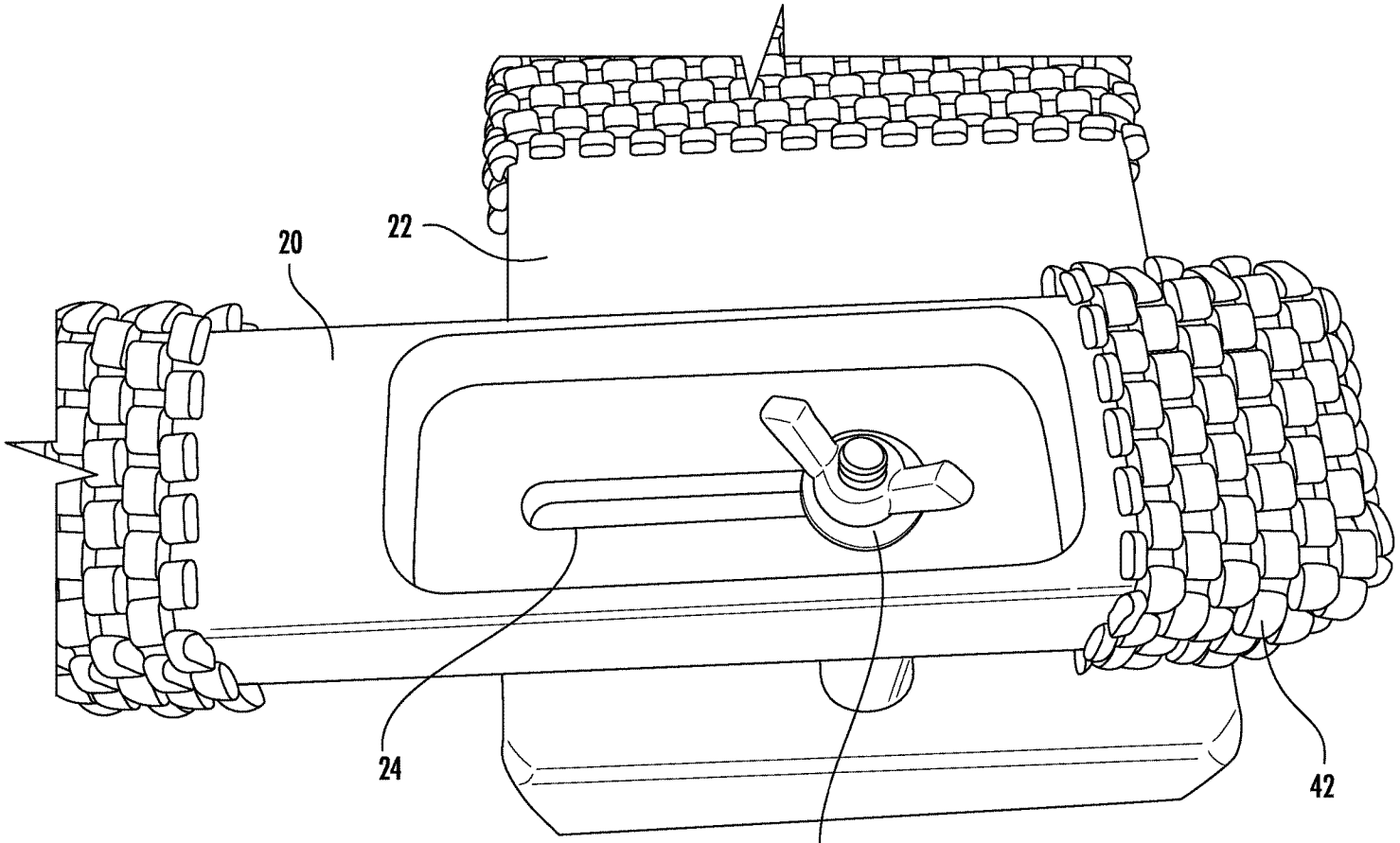
FIG. 4 is a detail view of area 4 of FIG. 3.
Figure 5:
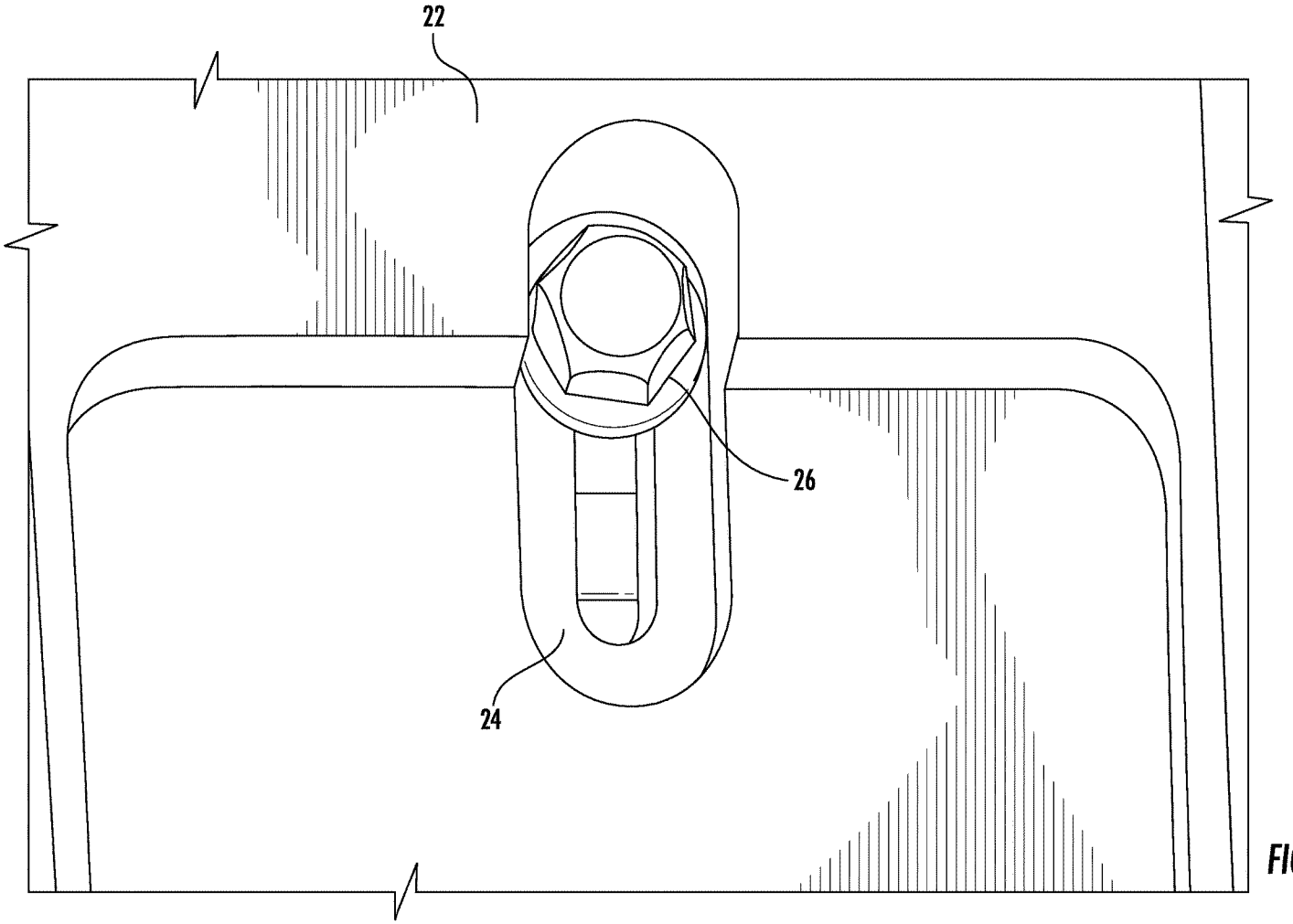
FIG. 5 is a detail view of area 5 of FIG. 2.

A pair of connecting holes 24 is defined in end portions of the pair of side members 20, 22 respectively. To attach the pair of end members 20 and the pair of side members 22, the connecting holes 24 of the pair of end members 20 are aligned with the connecting holes 24 of the pair of side members 22, with a bolt 26 or other connector being received through the aligned holes 24 and tightened by a fastener such as a wing nut. The attachments of the pair of end members 20 and the pairs of side members 22 create a vertical offset 28 (FIG. 2) which is equal to a height of the each of the pair of end members 20. When the pedal exerciser mounting frame 10 is fitted across the upper surface 17 of the overbed table 16, the vertical offset 28 allows the pair of side members 22 to engage with two parallel sides of the overbed table 16 as shown in FIG. 1. Referring to FIGS. 4 and 5, the aligned holes 24 can be elongated slots, so that the bolt 26 or other connectors can lock the relative position of the pair of end members 20 and the pair of side members 22. As such, the length L and width W of the central aperture defined by the pair of end members 20 and the pair of side members 22 can be adjusted by aligning the elongated slot 24.

The pair of end members 20 each includes top and bottom surfaces 32, 34, the top surface 32 having a pair of foot receiving recesses 36 therein for receiving a foot F of the pedal exerciser PE. The foot receiving recesses 36 are located at end portions of each of the pair of end members 20 and dimensioned to closely accommodate a foot F. Non-skid surfaces 42 are advantageously formed on or attached to each of the pair of end members 20 and/or the pair of side members 22 to provide a higher friction engagement with the bedside table 16. As shown in FIG. 1, second straps 19 can be used to further secure the forward foot and rear foot rods FR of the exerciser PE to the mounting frame 10. Preferably, the second strap 19 includes a hook and loop fastener, but other types of straps, such as a buckle, can be used.

Once the mounting frame 10 is mounted to the overbed table 16, the first strap 14 is used to wrap around both the pair of side members 22 and the underside of the bedside table 16 to secure the mounting frame 10 firmly against the surface 17. Preferably, the first strap 14 includes a hook and loop fastener, but other types of straps, such as a buckle, can be used.

Figure 6:
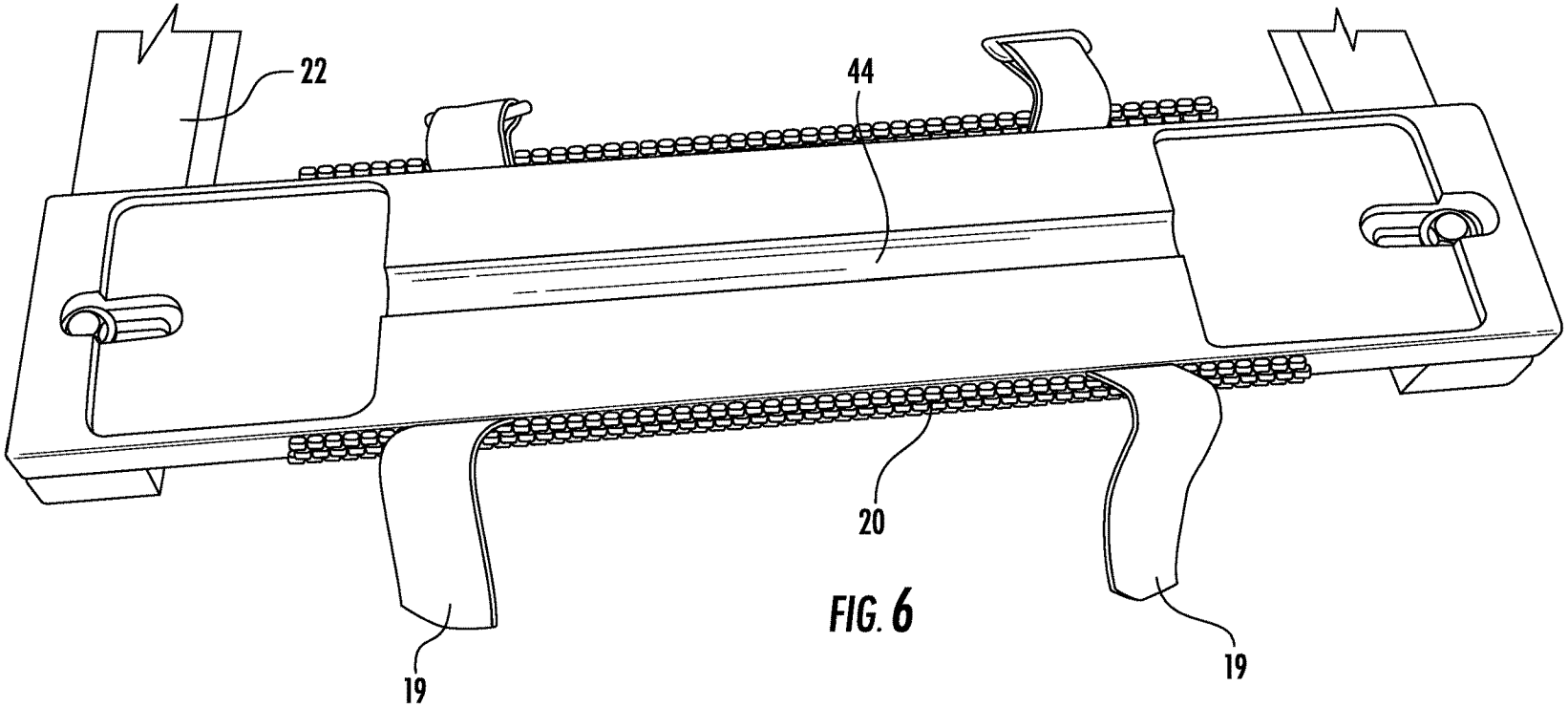
FIG. 6 is an upper perspective view of side members and end members of a pedal exercise mounting frame, according to another embodiment of the present invention.
Figure 7:
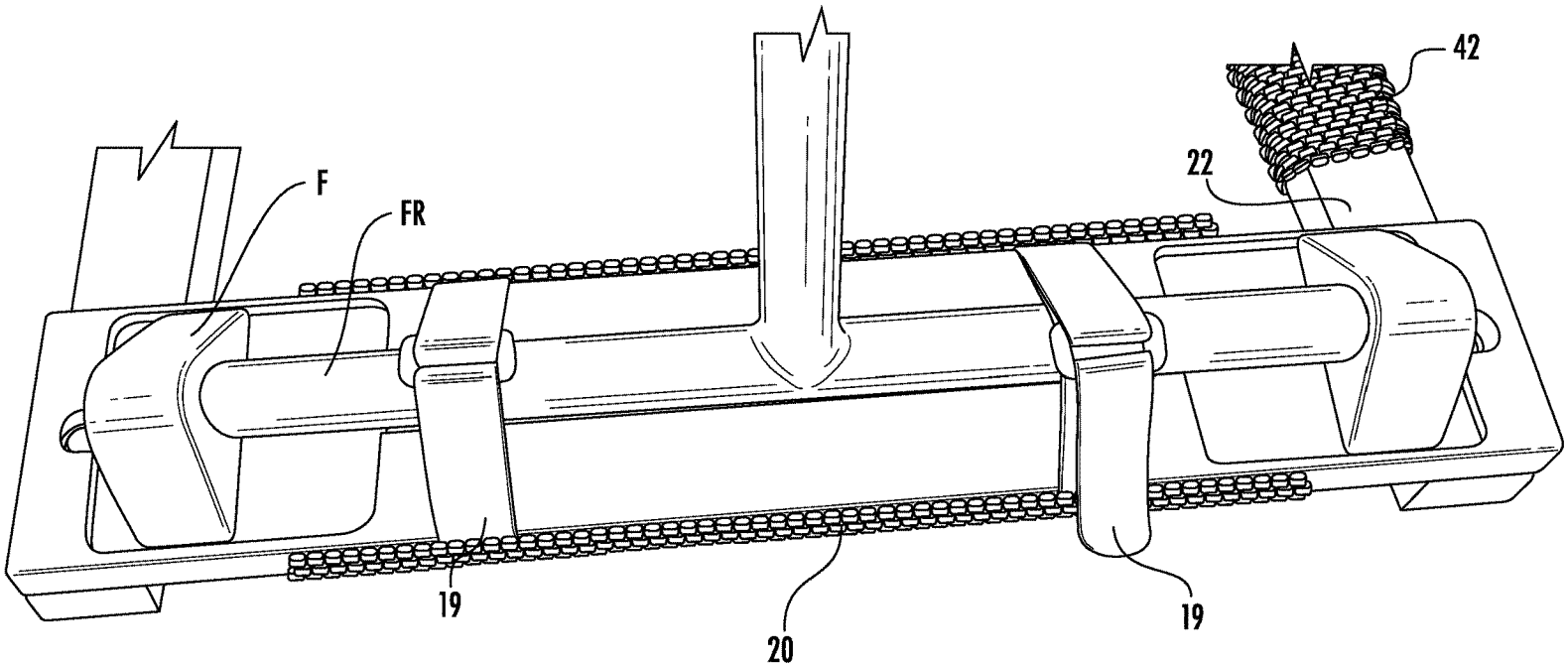
FIG. 7 is another upper perspective view of side members and end members of the pedal exerciser mounting frame of FIG. 6.

Referring to FIGS. 6 and 7, in an alternative embodiment, a groove 44 extends between the foot receiving recesses 36 on the surface of the pair of end members 20 to accommodate foot rod FR of the exerciser PE. FIG. 7 shows the foot rod FR fitted in the groove 44 and one or more second straps 19 are routed around each of the pair of end members 20 and secured to a foot rod FR.

Preferably, the mounting frame 10 is substantially rectangular in form. The pair of end members 20 and the pair of side members 22 are made of materials having suitable properties for a desired application, including strength, weight, rigidity, etc. Wood is generally preferred.

In the depicted embodiment, the pair of end members 20 and the pair of side members 22 have substantially rectangular or square cross-sections. Preferred dimensions believed to be suitable for standard overbed tables and pedal exercisers include a width and length of each of the pair of end members 20 of approximately 19 and 3.25 inches, respectively. The pair of side members 22 each has a width, length and height of approximately 1.5, 21-22 inches and about 0.75 inches, respectively. However, any other suitable dimensions can be used.

The foot cap receiving recesses 36 each has a width, length and depth that correspond to the feet of most pedal exercisers and may, for example, be on the order of 2, 3.25 and 0.2 inches. It will be appreciated that other shapes, configurations and dimensions may also be used, as deemed suitable for given application factors with factors such as overbed table dimensions.

Before mounting the frame 10, the height of the overbed table 16 is adjusted to conform to the patient. The frame 10 is then mounted to the top surface 17 of the overbed table 16 such that the pair of side members 22 each engages with the adjacent side of the overbed table 16. The length and width of the frame can be adjusted based on the dimension of the overbed table 16. Once the pedal exerciser mounting frame 10 is mounted on the top surface 17, the first strap 14 is extended across the central aperture 25 and the pair of the side members 20 such that the mounting frame 10 is secured to the overbed table 16, followed by tightening of the fasteners 26. The pedal exerciser PE is placed on the frame 10 by fitting the foot caps 38 to the foot receiving recesses 36. The second straps 19 are secured to the front and rear rod of the pedal exerciser PE to further secure the pedal exerciser PE. Then the pedal exerciser PE can be used for the patient's upper body. The mount 10 is preferably fitted to the end of the overbed table 16, creating easy access to the pedal exerciser PE by a patient sitting on the side of his or her bed.

From the foregoing, it will be appreciated that a pedal exercise mounting frame according to the present invention eliminates or minimizes the risk of patients getting hurt during their exercises, while retaining the full functionality of the pedal exerciser, and is a useful tool for physical therapy and occupational therapy.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A mounting frame for releasably securing a pedal exerciser to a table, the mounting frame comprising:

a frame assembly having a pair of generally opposed end members dimensioned to extend across an upper surface of the table and having recesses configured to receive feet of the pedal exerciser; and a pair of generally opposed side members connected to the pair of generally opposed end members at corresponding ends thereof so as to cooperatively define a central aperture therewith with the pair of generally opposed side members configured to engage opposite sides of the table; and a first strap dimensioned to extend across the central aperture and engage the pair of generally opposed side members so as to releasably secure the table therebetween.

2. The mounting frame of claim 1, wherein corresponding end portions of the end members and the pairs of generally opposed side members are each connected by at least one fastener inserted through aligned openings formed therein.

3. The mounting frame of claim 2, wherein the aligned openings are elongated slots configured to allow adjustment of length and width of the frame assembly.

4. The mounting frame of claim 1, wherein the pair of end members each has a pair of the foot receiving recesses located at end portions for receiving a foot of the pedal exerciser.

5. The mounting frame of claim 4, wherein each pair of end members comprises a groove between the ends thereof dimensioned to receive a rod extending between the feet fitted in the end member recesses.

6. The mounting frame of claim 5, wherein the mounting frame further comprises a second strap dimensioned to extend across the foot rod of the pedal exerciser so as to releasably secure the pedal exerciser.

7. The mounting frame of claim 1, wherein a non-skid surface is formed on at least one of the pair of end members and the pair of side members.

8. The mounting frame of claim 1, wherein the first strap includes a hook and loop fastener.

9. The mounting frame of claim 1, wherein the pair of generally opposed side members are perpendicular to the pair of generally opposed end members.

10. A pedal exerciser assembly comprising:

a table;

a mounting frame mounted on the table; and a pedal exerciser fitted on the mounted frame; and wherein the mounting frame comprises:

a pair of generally opposed end members extending across an upper surface of the table and receiving feet of the pedal exerciser; and a pair of generally opposed side members connected to the pair of generally opposed end members at corresponding ends thereof so as to cooperatively define a central aperture therewith with the pair of generally opposed side members engaging opposite sides of the table; and a first strap extending across the central aperture, engaging the pair of generally opposed side members, and releasably securing the table therebetween.

11. The pedal exerciser assembly of claim 10, wherein corresponding end portions of the pair of end members and the pair of generally opposed side members are each connected by at least one fastener inserted through aligned openings formed therein.

12. The pedal exerciser assembly of claim 10, wherein the aligned openings are elongated slots configured to allow adjustment of length and width of the frame assembly.

13. The pedal exerciser assembly of claim 10, wherein the mounting frame further comprises a second strap dimensioned to extend across and engage foot rod of the pedal exerciser so as to releasably secure the pedal exerciser therebetween.

14. The pedal exerciser assembly of claim 10, wherein the pair of generally opposed side members are perpendicular to the pair of generally opposed end members.

* * * * *